US006064470A

United States Patent [19]

Karashima et al.

[11] Patent Number: 6,064,470

[45] Date of Patent: May 16, 2000

[54] APPARATUS AND METHOD FOR CLEANING A TRANSFER DEVICE OF AN IMAGE FORMING APPARATUS

[75] Inventors: Kenji Karashima; Hisashi Fuzisaki, both of Kawasaki; Mayumi Yoshida, Tokyo, all of Japan

[73] Assignee: Ricoh Company, Ltd., Tokyo, Japan

[21] Appl. No.: 08/537,352

[22] Filed: Oct. 2, 1995

[30] Foreign Application Priority Data

Sep. 30, 1994 [JP] Japan ..... 6-237942

[51] Int. Cl.[7] ..... G03G 15/16

[52] U.S. Cl. ..... 355/271

[58] Field of Search ..... 355/208, 271, 355/273, 274, 296

[56] References Cited

U.S. PATENT DOCUMENTS 4,998,143 3/1991 Kumasaka et al. ..... 355/271

5,532,795 7/1996 Tatsumi et al. ..... 355/271 X

FOREIGN PATENT DOCUMENTS 63-247780 10/1988 Japan .

4-336575 11/1992 Japan .

6-308842 11/1994 Japan .

*Primary Examiner*—Joan H. Pendegrass

*Attorney, Agent, or Firm*—Oblon, Spivak, McClelland, Maier & Neustadt, P.C.

[57] ABSTRACT

A contact type image transferring device and method incorporated in an image forming apparatus for cleaning a residual toner on a transfer roller. The transfer roller is in contact with a photoconductive drum at a first force and forms nip between the roller and the drum. A sheet of paper passes through the nip and a toner image on the drum is transferred to the sheet of paper. When the sheet of paper is not at the nip, the transfer roller is moved such that the force of the roller against the drum is a second force which is different from the first force. A cleaning bias voltage is applied to the roller and toner on the roller is transferred to the drum.

16 Claims, 4 Drawing Sheets

APPARATUS AND METHOD FOR CLEANING A TRANSFER DEVICE OF AN IMAGE FORMING APPARATUS

BACKGROUND OF THE INVENTION

1. Field of the Invention

The present invention relates to an image transferring device for an image forming apparatus such as a copier, printer, facsimile transceiver or similar photographic image forming apparatus in which an image is formed on a photoconductive element. More particularly, the invention is concerned with a contact type image transferring device including, for example, a transfer roller or a transfer belt, for transferring a toner image from the photoconductive element to a sheet of paper which is passed through a nip between the photoconductive element and the image transferring device. The present invention further relates to a method and apparatus for electrically cleaning the transferring device which varies a force between the transfer device and the photoconductive element.

2. Description of the Related Art

It is a common practice for an image forming apparatus of the kind described above to use a contact type image transferring device. The contact type device transfers a toner image from a photoconductive element to a sheet passed through a nip between the photoconductive element and the transfer device to which an electrical field opposite in polarity to the toner image is applied. Since the contact type transfer device is in direct contact with the photoconductive element when the sheet is not at the nip portion, the toner image on the surface of the photoconductive element transfers to the surface of the transfer device. As a result, the toner image on the transfer device is transferred to the back side of the sheet.

Japanese Laid-Open Patent Publication No. 3-69978 discloses a cleaning device for a transfer roller in which toner on the surface of the roller is transferred to the photoconductive element by applying cleaning bias voltage to the transfer roller when the transfer roller is in direct contact with the photoconductive element. Since there is not only regular toner having a positive polarity but also oppositely charged toner having a negative polarity, for cleaning both types of toner, the related art discloses that the polarity of a cleaning bias voltage is switched over between the positive polarity and the negative polarity.

However, if a jammed sheet which carries un-fixed toner on it is in contact with the surface of the roller and a large quantity of toner is adhered to the transfer roller, it takes a long time to transfer all toner on the surface of the roller to the surface of the photoconductive element. As a result, users cannot use the image forming apparatus for a long period of time because during the cleaning process, the apparatus cannot operate.

SUMMARY OF THE INVENTION

Accordingly, one object of this invention is to provide a novel image transferring device for an image forming apparatus which can solve the aforementioned drawbacks. A further object of the present invention is to provide an image transferring device for an image forming apparatus for which the cleaning aspect for a contact type transfer device can be performed.

In order to achieve the above-mentioned objects, according to the present invention, an apparatus for transferring a toner image on an image carrier to a sheet includes a contact transferring device which is in direct contact with the image carrier when the sheet is not at nip between the image carrier and the transferring device, a transfer bias power source which applies transfer bias voltage to the transferring device to transfer the toner image from the image carrier to the sheet, a cleaning bias power source which applies cleaning bias voltage to the transferring device to transfer toner from the transferring device to the image carrier, a force control device which controls the force of the transferring device against the image carrier and a control board which outputs a control signal to the force control device so as to change the force of the transferring device against the image carrier between transferring operation and cleaning operation. Other objects and aspects of the present invention will become apparent herein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
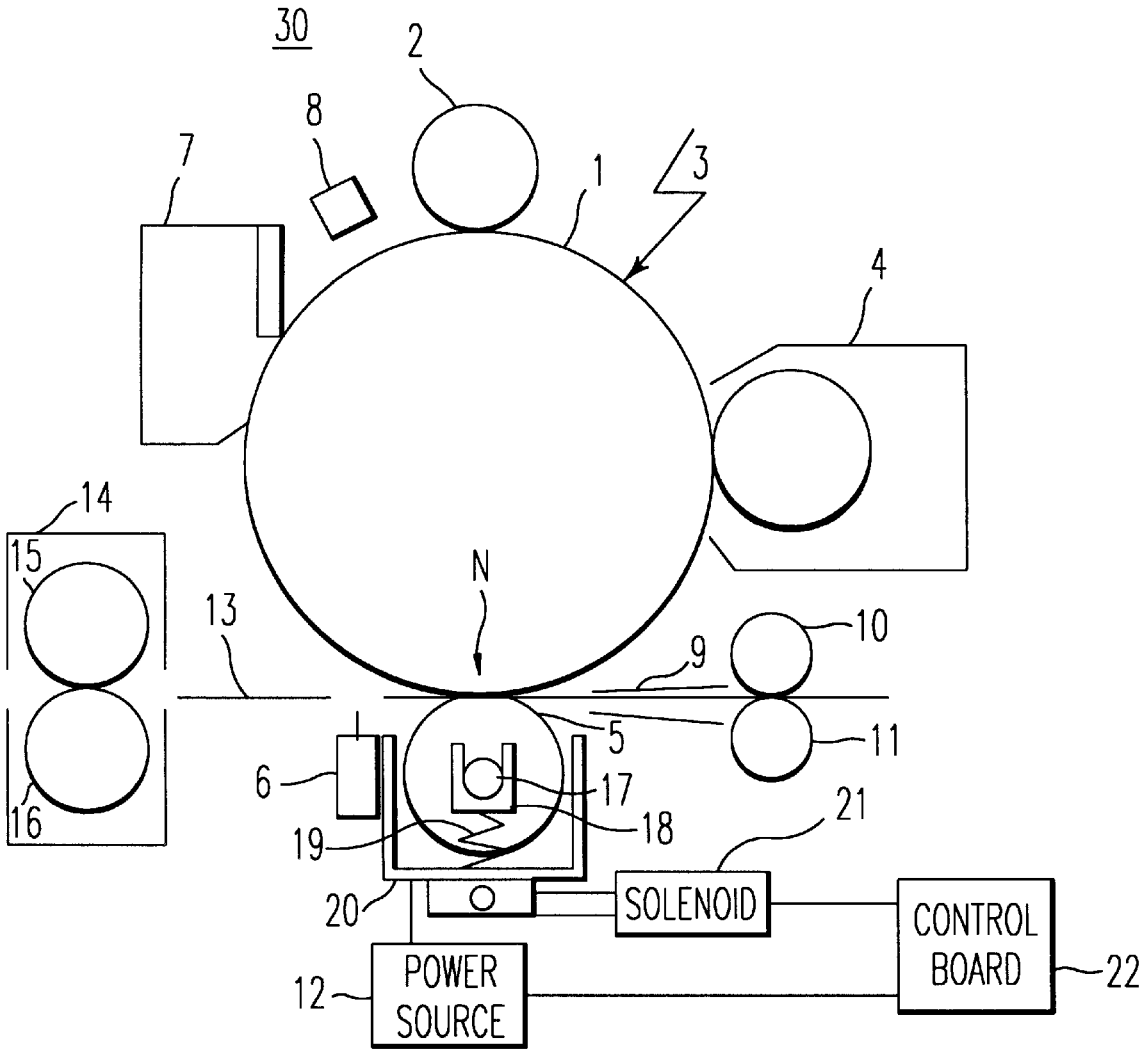
FIG. 1 is a schematic representation showing the general construction of an image forming apparatus embodying the present invention.

Referring now to the drawings, wherein like reference numerals designate identical or corresponding parts throughout the several views, and more particularly to FIG. 1 thereof, an image forming apparatus 30 embodying the present invention is shown. The image forming apparatus 30 has a rotatable photoconductive drum 1. The apparatus 30 also has the following elements which may be conventional and disposed around the drum: a charging device or roller 2 which charges the photoconductive drum 1, an exposing device 3 which forms a latent image on the photoconductive drum 1, a developing device 4 which develops the latent image and forms a toner image on the photoconductive drum 1, a transfer roller 5 which transfers the toner image to a sheet of paper, a paper separating device 6 including an electrode which separates the sheet of paper after the transfer operation is performed, a cleaning device 7 which cleans residual toner which is on the photoconductive drum 1 and a discharging lamp 8 which discharges an electric charge on the photoconductive drum 1.

The transfer roller 5 is in pressured contact with the photoconductive drum 1 and makes a nip N between the photoconductive drum 1 and the roller 5. A power source 12 is connected to and applies a transfer bias voltage to the transfer roller 5. The power source has a switching circuit (not illustrated) which switches over the polarity of transfer bias voltage between a positive and negative polarity. The power source 12 is connected to a control board 22 which applies a control signal to the power source 12 in order to control an output timing of the bias voltage, the output voltage value, the polarity of the transfer bias voltage from the power source 12, and so on.

An electrically conductive shaft 17 of the transfer roller 5 is supported on the bearings 18 which are made of an electrically conductive resin. The bearings 18 are supported on a conductive spring 19 in a frame 20 the which allows bearings 18 to move up and down. The transfer bias voltage from the power source 12 is applied to the transfer roller 5 via the conductive spring 19 and the conductive bearings 18.

A force control device 21 which is a bidirectional solenoid is connected to the frame 20 via a mechanical link (not illustrated) and electrically connected to the control board 22. The force control device 20 moves the frame 20 up and down based on a control signal from the control board 22. As a result, the force of the transfer roller 5 against the photoconductive drum 1 is controlled.

The transfer roller 5 includes the electrically conductive shaft 19 and coated on the shaft is an electrically conductive foam layer such as silicon rubber, urethane rubber, epichlorohydrin rubber, EPDM or combinations thereof. The electrically conductive foam layer has an electrically resistance between $10^6$ Ω·cm and $10^{11}$ Ω·cm. The hardness of the layer is between 30° and 35° (Asker C). Since the electric resistance at the ends of the roller 5 is smaller than the other (central) portion of the roller 5, unusual discharge from the ends of the roller may occur. In order to prevent the unusual discharge, the ends of the roller 5 are tapered. The length of the roller 5 is smaller than that of the photoconductive drum 1.

In operation, the surface of the photoconductive drum 1 is negatively charged by the charging device 2. The charged surface of the drum 1 is exposed by the exposing device 3 which forms an electric latent image. The electric latent image is developed by the developing device 4 in which toner is negatively charged. The sheet of paper P is fed from a paper tray (not illustrated) to a pair of resister rollers 10 and 11 and then to the nip N by the resister rollers 10 and 11 via a pair of paper guide plates 9. The sheet of paper P is in pressured contact with the photoconductive drum 1 by the transfer roller 5 at the nip N. Since a positive polarity bias voltage is applied from the power source 21 to the transfer roller 5, the toner image which is negatively charged is transferred from the photoconductive drum 1 to the sheet of paper P. The sheet of paper P is then discharged by the discharge electrode of the paper separate device 6 and then the sheet of paper P is separated from the photoconductive drum 1. The sheet of paper P on which the toner image is formed is then transported to a fixing device which has a heat roller 15 and a pressure roller 16 via a guide plate 13, and the toner image is fixed on the sheet. The sheet of paper P is then discharged to a paper discharge tray (not illustrated). After the transfer operation, residual toner on the surface of the photoconductive drum 1 is cleaned by the cleaning device 7, and residual electricity on the drum 1 is discharged by the discharge lamp 8.

Figure 2:
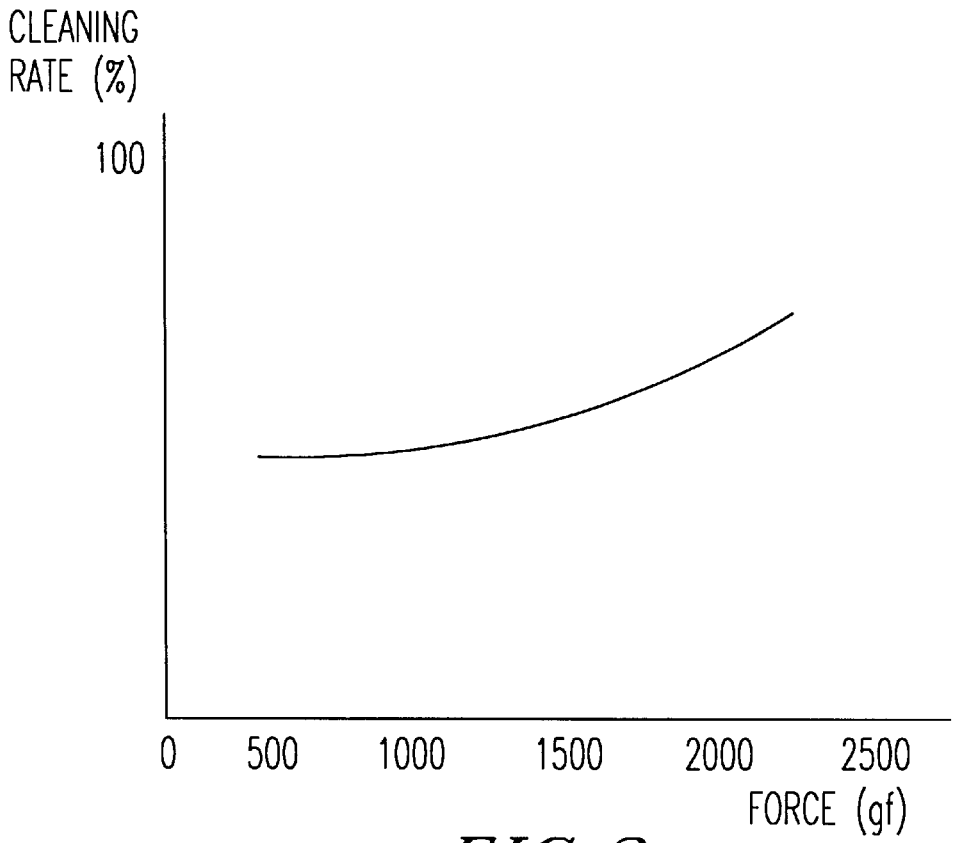
FIG. 2 is a graphical representation showing a relationship between the force of a transfer roller against a photoconductive element and a cleaning rate according to the present invention.

The inventors have conducted experiments of the cleaning ability of the transfer roller. As a result of the experiments, it was found that there is a close relationship between the cleaning ability and the force of the transfer roller against the photoconductive drum. FIG. 2 shows the cleaning rate under varying force of the transfer roller 5 against the photoconductive drum 1. The cleaning rate shows cleaning ability and is determined according to the following equation:

$$\text{Cleaning Rate } (\%) = A/B \times 100 \quad (1)$$

where A is the quantity of toner which is transferred from the transfer roller 5 to the photoconductive drum 1, and B is the quantity of toner which was on the roller 5 before the cleaning operation began. In this experiment, a toner image on the photoconductive drum 1 was transferred to the transfer roller 5 when a sheet was not at the nip N. After the toner was transferred to the transfer roller 5, the cleaning bias voltage whose polarity was the same as that of toner on the roller 5 was applied to the roller 5. During this experiment, the force of the transfer roller 5 against the photoconductive drum 5 was varied. The transfer roller 5 which includes an electrically conductive foam layer and has a hardness of between 30° and 35° (Asker C) was used.

The experiment indicated that the cleaning ability of toner on the surface of the transfer roller was good when the force of the transfer roller 5 against the photoconductive drum 1 was more than 1.0 kgf. The term "1.0 kgf" means one kilogram of force; kg is kilograms, and f is the acceleration of gravity which is 9.8 $m/s^2$ so that the units of force are properly described in newtons. At that force, since the mechanical adhesion between the surface of the roller 5 and that of drum 1 was increased, toner adhered to the roller 5 was transferred to the surface of the drum 1. Further, since the foam layer of the roller 5 was deformed and the distance between the toner which is in holes of the foam layer and the surface of the drum 1 was decreased, static electricity acting on the toner was increased and the toner adhered to the roller 5 was transferred to the surface of the drum 1.

As a result of the experiment, it was found that if the force of the roller 5 against the drum 1 was more than 2.0 kgf, the shaft of the roller 5 was deformed and a photoconductive layer of the drum 1 was scraped and damaged. Therefore it is desirable that the force of the transfer roller 5 against the photoconductive drum 1 to be between 1.0 kgf and 2.0 kgf when the cleaning operation is performed.

Next, the inventors conducted an experiment in transfer ability. In this experiment, various kinds of sheets were fed to the nip N and a toner image on the sheet was evaluated. As a result of the experiment, it was found that the toner image on the sheet was good when the force of the transfer roller 5 against the photoconductive drum 1 is less than 1.0 kgf. When an OHP sheet (Over Head Projector sheet) was used, it was hard to transfer a center of the toner image. However, it was found that when the force of the transfer roller against the photoconductive drum was less than 1.0 kgf, the center of the toner image was transferred to the sheet.

As a result of the above tests, it was found that if the force of the transfer roller 5 against the photoconductive drum 1 was between 1.0 kgf and 2.0 kgf, the cleaning ability of the transfer roller was good, and if the force was less than 1.0 kgf, the transfer ability of the toner image to the sheet was good.

Figure 3:
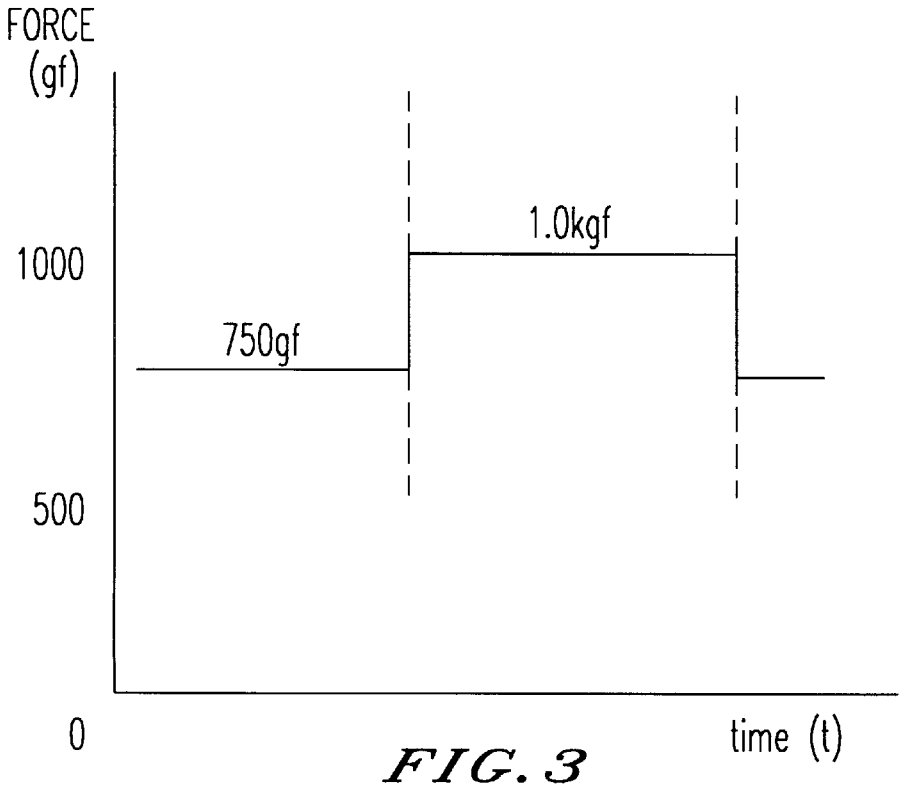
FIG. 3 shows a force of the transfer roller against the photoconductive element when the apparatus is in a transfer mode and in a cleaning mode according to the present invention.

FIG. 3 shows the force of the transfer roller 5 against the photoconductive drum 1 during the transfer operation and the cleaning operation. Referring to FIGS. 1 and 3, the positive polarity transfer bias voltage is applied to the transfer roller 5 and toner image which has a negative polarity is transferred to the sheet. During the transfer operation, the frame 20 is positioned in a first position at which the force of the roller 5 against the drum 1 is 750 gf.

In this case, the width of the nip N is between 1.0 mm and 1.5 mm. The amount of force being applied is dependant on the position of the frame 20 relative to the photoconductive drum 1 and is adjusted by the force control device 21.

After the sheet passes through the nip N, the switching circuit in the power source 12 switches the transfer bias voltage from the positive polarity to the negative polarity in response to the control signal from the control board 22, and then the cleaning operation is started. At the same time, the control board 22 outputs a position control signal to the force control device 21. The force control device 21 moves the frame 20 to a second position where the force of the transfer roller 5 against the photoconductive drum 1 is between 1.0 kgf and 1.5 kgf. When the cleaning operation is completed, the control board 22 outputs the position control signal to the force control device 21, and then the device 21 moves the frame 20 back to the first position where the force of the transfer roller 5 against the photoconductive drum 1 is 750 gf.

Figure 4:
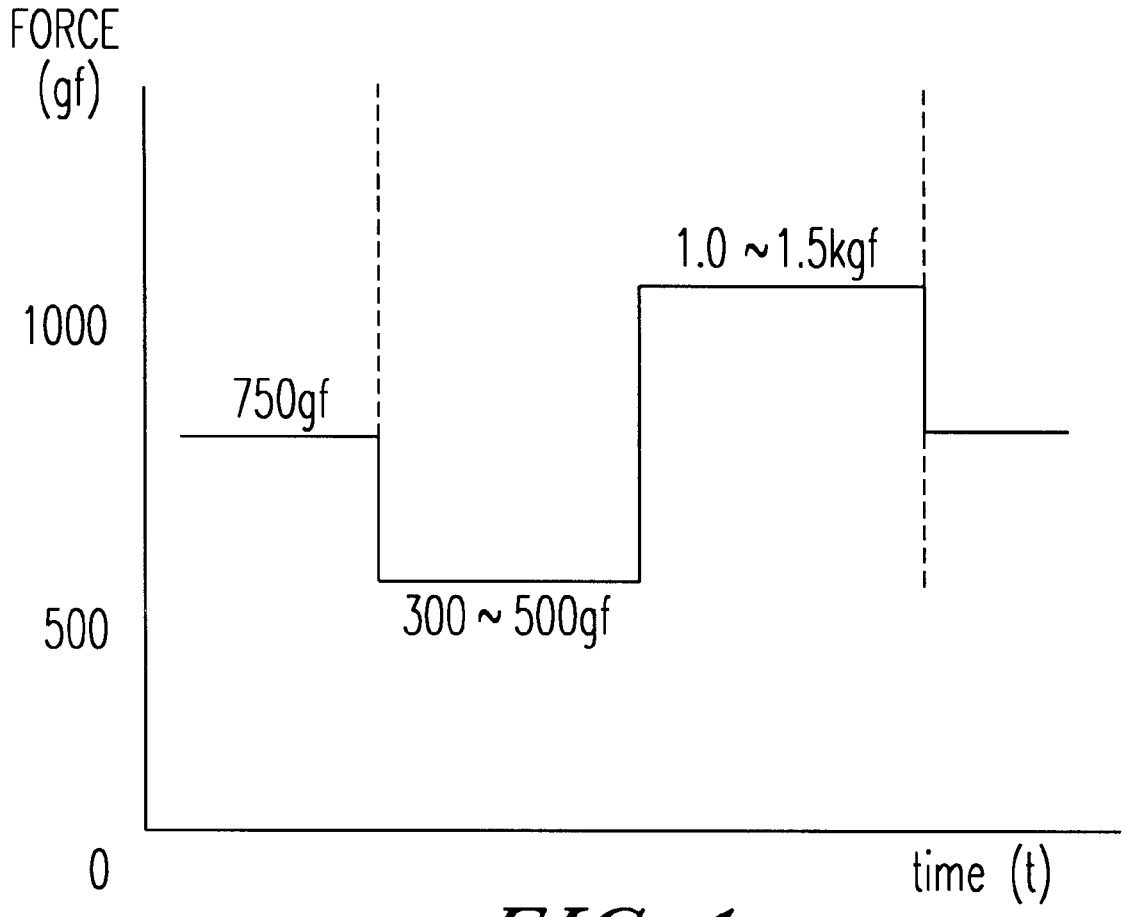
FIG. 4 shows a force of the transfer roller against the photoconductive element when the apparatus is in a transfer mode and in a cleaning mode according to a modified embodiment of the present invention.

FIG. 4 shows a timing diagram of a modified embodiment of this invention. Referring to FIGS. 1 and 4, the transfer bias voltage having a positive polarity is applied to the transfer roller 5 and the toner image having a negative polarity is transferred to the sheet. During the transfer operation, the frame 20 is positioned in the first position by the force control device 21 where the force of the roller 5 against the drum 1 is 750 gf. In this case, the width of the nip N is between 1.0 mm and 1.5 mm.

After the sheet passes through the nip N, the switching circuit in the power source 12 switches the transfer bias voltage from the positive polarity to the negative polarity in response to the control signal from the control board 22, and then the cleaning operation is started.

When a large quantity of toner is adhered to the transfer roller 5, it is difficult to transfer the toner from the roller 5 to the photoconductive drum 1, even if the force of the roller 5 against the drum 1 is increased. The surface layer of the toner which is adhered to the roller 5 is transferred to the drum 1 by the cleaning bias voltage. However the lower layer of the toner which is adhered to the roller 5 is forced into small holes of the foam layer of the roller 5 by the force of the roller 5 against the drum 1. This toner which is compressed and forced into the holes is difficult to remove from the holes.

In order to eliminate the aforementioned drawbacks, according to the present embodiment, the control board 22 outputs a position control signal to the position control device 21, and the position control device 21 moves the frame 20 to a third position at which the force of the roller 5 against the drum 1 is between 300 gf and 500 gf when the cleaning operation starts. The frame 20 is positioned in the third position for a predetermined period of time, and the cleaning bias voltage having a negative polarity is applied to the transfer roller 5. As a result of that cleaning operation, a quantity of toner is transferred from the roller 5 to the drum 1 without compressing the toner into the holes of the roller 5. Then the position control board 22 outputs a position control signal to the force control device 21 so as to move the frame 20 to the second position where the force of the roller 5 against the drum 1 is between 1.0 kgf and 1.5 kgf, and the cleaning bias voltage is continuously applied. As a result of this cleaning operation, residual toner on the roller 5 is transferred to the drum 1.

After the cleaning operation is completed, the force control device 21 moves the frame 20 to the first position where the force of the roller 5 against the drum 1 is 750 gf. According to the present embodiment, toner which is adhered to the transfer roller 5 is transferred to the photoconductive drum 1 without being compressed into the holes of the roller. It is also possible to position the frame 20 in the first position and then to move the frame 20 to the second position during the cleaning operation.

Figure 5:
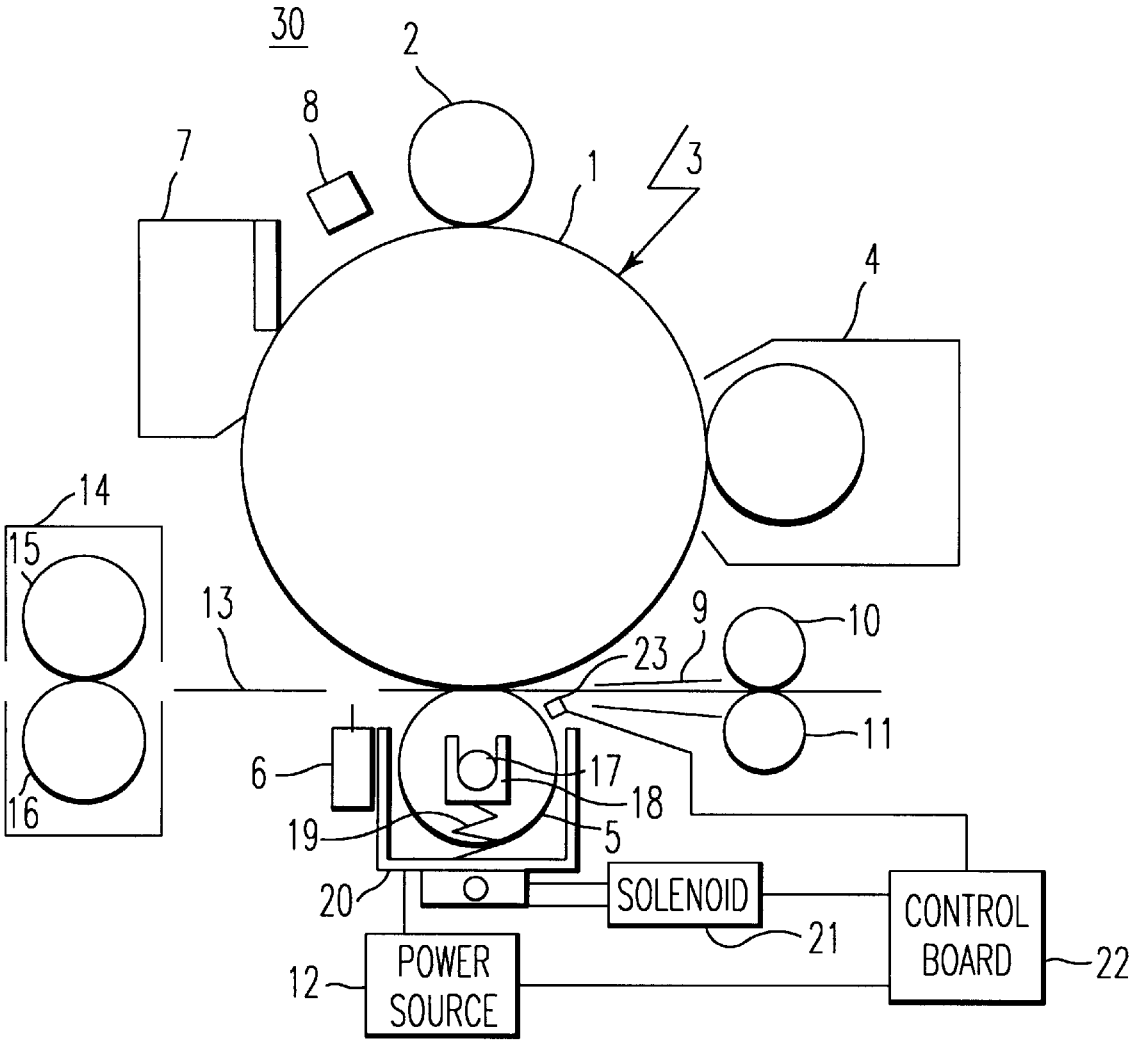
FIG. 5 is a schematic representation showing the general construction of an image forming apparatus of a modified embodiment of the present invention.

FIG. 5 shows another modified embodiment of this invention. In this embodiment, there is a photosensor 23 which detects a quantity of toner on the transfer roller 5 and outputs a signal which is inputted by the control board 22. The control board 22 compares a value of the signal with a reference value which is stored in the control board, for example, in a memory. As a result of the comparison, if the value of the output signal is larger than the reference value, indicating that a large quantity of toner is adhered to the transfer roller 5, the force of the roller 5 against the drum 1 is automatically changed during the cleaning operation as shown in FIG. 4. If the value of the output signal is not greater than the reference value, the pressure of the roller 5 against the drum 1 is not changed during the cleaning operation as shown in FIG. 3.

It is also possible to apply the cleaning bias voltage which is switched from the negative polarity to the positive polarity during the cleaning operation in order to transfer not only regularly charged toner but also inversely charged toner which is adhered to the transfer roller 5.

The present invention uses one or more control boards to perform the above-described functions. These boards may be implemented using conventional microprocessors or a conventional general purpose digital computer programmed according to the teachings of the present application, as will be appropriate to those skilled in the art. Appropriate software coding can readily be prepared by skilled programmers based on the teachings of the present disclosure, as will be apparent to those skilled in the software art. The invention may also be implemented by the preparation of applications specific integrated circuits or by interconnecting an appropriate network of conventional component circuits, as will be readily apparent to those skilled in the art.

Obviously, numerous modification and variations of the present invention are possible in light of the above teachings. For example, the preferred force values of the roller 5 against the photoconductive drum 1 may be different than described above, depending on the construction of the image forming apparatus. It is therefore to be understood that within the scope of the appended claims, the invention may be practiced otherwise than as specifically described herein.

What is claimed is as new and is desired to be secured by Letters Patent and the United States is:

1. An apparatus for transferring a toner image on an image carrier to a sheet, comprising:

a contact transferring device which is in direct contact with said image carrier when said sheet is not at a nip between said image carrier and said contact transferring device;

a transfer bias power source which applies a transfer bias voltage to said contact transferring device to transfer said toner image from said image carrier to said sheet;

a cleaning bias power source which applies a cleaning bias voltage to said transferring device to transfer toner from said transferring device to said image carrier;

a force control device which controls a force of the contact transferring device against said image carrier; and a control board which outputs a control signal to said force control device so as to change the force of said contact transferring device against said image carrier between transferring operation and cleaning operation.

2. An apparatus as claimed in claim 1, wherein said control board controls said force control device such that said force during said cleaning operation is greater than said force during said transferring operation.

3. An apparatus as claimed in claim 1, wherein said control board controls said force control device such that said force is changed during said cleaning operation.

4. An apparatus as claimed in claim 3, wherein said control board controls said force control device such that said force during a first portion of said cleaning operation is not greater than said force during said transferring operation, and said force is changed during said cleaning operation such that said force during a second portion of said cleaning operation is greater than said force during said transferring operation.

5. An apparatus as claimed in claim 1, further comprising:

a sensor which senses a quantity of toner on said contact transferring device; and means for automatically selecting a first or a second cleaning mode in response to the quantity of toner sensed by said sensor, the first cleaning mode for keeping constant said force of said contact transferring device against said image carrier during the cleaning operation, and the second cleaning mode for changing said force during the cleaning operation.

6. An apparatus as claimed in claim 5, wherein said control board controls said force control device such that said force during said first cleaning mode is greater than said force during said transferring operation.

7. An apparatus as claimed in claim 5, wherein said control board controls said force control device such that a first force used during said second cleaning mode is not greater than said force of said transferring operation, and a second force used during said second cleaning mode is greater than said force of said transferring operation.

8. An apparatus as claimed in claim 1, wherein said force control device is a bidirectional solenoid.

9. An apparatus as claimed in claim 1, wherein said cleaning bias power source applies said cleaning bias voltage which has a same polarity as a polarity of said toner image.

10. An apparatus as claimed in claim 1, further comprising a means for switching said cleaning bias voltage between a negative polarity and a positive polarity.

11. A method for transferring a toner image on an image carrier to a sheet, comprising the steps of:

positioning a contact transferring device relative to the image carrier such that a first force acts against said image carrier;

applying transfer bias voltage to said contact transferring device to transfer said toner image to said sheet;

positioning said contact transferring device relative to the image carrier such that a second force, different from said first force, acts against said image carrier after said sheet passes through a nip between said image carrier and said contact transferring device; and applying, during a cleaning operation, a cleaning bias voltage to said contact transferring device.

12. A method as claimed in claim 11, wherein said positioning steps are performed such that said second force is greater than said first force.

13. A method as claimed in claim 11, wherein said positioning steps are performed such that said second force is not greater than said first force during a first portion of a cleaning operation, and said second force is changed such that said second force is greater than said first force during a second portion of the cleaning operation.

14. A method as claimed in claim 11, further comprising the steps of:

sensing a quantity of toner on said transferring device; and selecting a first or second cleaning mode in response to the quantity of toner sensed by said sensing step, the first cleaning mode for keeping constant said second force which is greater than said first force during the cleaning operation, and the second cleaning mode for changing said second force such that an initial force of the second cleaning mode is not greater than said first force and a subsequent force of the second cleaning mode is greater than said first force.

15. A method as claimed in claim 11, wherein said step of applying a cleaning bias voltage applies said cleaning bias voltage which has a same polarity as a polarity of said toner image.

16. A method as claimed in claim 11, wherein said step of applying the cleaning bias voltage includes switching the cleaning bias voltage between a negative polarity and a positive polarity.

* * * * *